US011511955B2

(12) United States Patent
Mizumukai

(10) Patent No.: US 11,511,955 B2
(45) Date of Patent: Nov. 29, 2022

(54) DOCUMENT FEEDER

(71) Applicant: Brother Kogyo Kabushiki Kaisha, Nagoya (JP)

(72) Inventor: Wataru Mizumukai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 69 days.

(21) Appl. No.: 17/109,959

(22) Filed: Dec. 2, 2020

(65) Prior Publication Data

US 2021/0171299 A1 Jun. 10, 2021

(30) Foreign Application Priority Data

Dec. 5, 2019 (JP) ..... JP2019-220091

(51) Int. Cl.

| | |
|---|---|
| ***B65H 1/14*** | (2006.01) |
| ***B65H 1/08*** | (2006.01) |
| ***B65H 5/06*** | (2006.01) |
| ***B65H 7/04*** | (2006.01) |
| ***B65H 3/06*** | (2006.01) |

(52) U.S. Cl.

CPC ..... *B65H 1/14* (2013.01); *B65H 1/08* (2013.01); *B65H 3/0661* (2013.01); *B65H 3/0669* (2013.01); *B65H 5/06* (2013.01); *B65H 7/04* (2013.01); *B65H 2511/11* (2013.01); *B65H 2511/515* (2013.01); *B65H 2511/52* (2013.01)

(58) Field of Classification Search

CPC ..... B65H 1/08; B65H 1/14; B65H 3/0669; B65H 5/06; B65H 5/062; B65H 7/02; B65H 7/04; B65H 7/14; B65H 7/18; B65H 7/20; B65H 2511/11; B65H 2511/515; B65H 2511/52; B65H 2513/512; B65H 2513/514

See application file for complete search history.

(56) References Cited

U.S. PATENT DOCUMENTS

| | | | | |
|---|---|---|---|---|
| 2009/0057984 A1* | 3/2009 | Matsumoto | B65H 7/18 271/10.09 |
| 2012/0314267 A1* | 12/2012 | Suzuki | B65H 3/5261 271/10.03 |
| 2021/0122594 A1* | 4/2021 | Okamoto | B65H 7/02 |

FOREIGN PATENT DOCUMENTS

| | | |
|---|---|---|
| JP | H05-011523 A | 1/1993 |
| JP | 2011-234130 A | 11/2011 |
| JP | 2016-189569 A | 11/2016 |

* cited by examiner

*Primary Examiner* — Prasad V Gokhale

(74) *Attorney, Agent, or Firm* — Banner & Witcoff, Ltd.

(57) ABSTRACT

According to aspects of the present disclosures, when a cancel command is input during a document conveying process, drive of a conveying motor is stopped. Then, a movable plate of a feed tray is moved down from a supplying position to a lowermost position being a non-supplying position, and the drive of the conveying motor is restarted. The conveying motor is driven at least until a document sheet is discharged from a conveying path.

8 Claims, 6 Drawing Sheets

DOCUMENT FEEDER

CROSS-REFERENCE TO RELATED APPLICATIONS

This application claims priority under 35 U.S.C. § 119 from Japanese Patent Application No. 2019-220091 filed on Dec. 5, 2019. The entire subject matter of the application is incorporated herein by reference.

BACKGROUND

Technical Field

The present disclosures relate to a document feeder.

Related Art

Conventionally, there has been known an image scanning device provided with an auto document feeder (ADF). Typically, in such an image scanning device, document sheets stacked on a tray are fed into a housing one-by-one by a pickup roller, and an image on the document sheet is scanned by a contact image sensor (CIS) while the document sheet is conveyed in the housing by conveying rollers.

SUMMARY

Among conventional ADFs, there has been known one including a clutch. The clutch is configured such that a pin is implanted in a rotation shaft of the pickup roller, and a protrusion configured to engage with the pin is provided to the pickup roller. Thus, when a rotating direction of the pickup roller and a rotating direction of the rotation shaft are opposite to each other, a driving force of the rotation shaft is not transmitted to the pickup roller. In such an ADF, a pickup operation to pick up the document sheets from the tray one-by-one and feed the document into a conveying path, and a conveying operation to convey the document sheet along the conveying path are realized by a single motor.

In such an ADF, a conveying speed on a downstream side of the conveying path is typically designed to be slightly higher than a conveying speed on an upstream side, at the time when a downstream-side roller starts conveying the document sheet, a rotating direction of an upstream-side roller becomes opposite to a rotating direction of a rotation shaft of the upstream-side roller, and engagement of the pin and the protrusion is released. Therefore, while the document sheet is being pulled by the downstream-side roller, a distance between the pin and the protrusion on the upstream side becomes larger. Thereafter, when the document sheet has passed through the upstream-side roller, since the upstream-side roller does not receive a driving force from the document sheet, a rotation of the upstream-side roller is stopped. However, since the rotation shaft of the upstream-side roller keeps rotating, the distance between the pin and the protrusion becomes smaller. When the pin and the protrusion engage with each other again, the upstream-side roller starts rotating by a driving force received from the rotation shaft. With this configuration, even when the single motor is kept driven, a plurality of document sheets is not conveyed continuously, and a necessary distance is formed between the conveyed document sheet and the subsequently conveyed document sheet.

In the ADF, there could be a case where scanning operation is interrupted, during a scanning operation of the plurality of document sheets using the ADF is executed, since a stop key to stop the scanning operation is pressed due to user's reasons or when an error occurs in an image forming unit configured to print scanned images on printing sheets. In such a case, it is preferable that the document sheets, which are being conveyed by the ADF, are discharged so as not to remain in the conveying path.

While the plurality of document sheets is fed by the ADF employing the clutch, the next document sheet stacking on the tray is sequentially picked up. Therefore, even when the scanning operation is stopped, an operation of the ADF is not normally stopped until all document sheets stacked on the tray are discharged. Thus, even if a conveying speed increases after the scanning operation is stopped, the user needs to wait without doing anything until all document sheets are discharged. Further, in the conventional ADF, since the document sheets which do not need to be conveyed is conveyed, there is a possibility that a lifetime of the ADF is shortened or the document sheets are damaged.

According to aspects of the present disclosures, there is provided a document feeder including a feed tray configured to support a document sheet, a supplying roller configured to supply the document sheet supported by the feed tray into a conveying path, a tray lifting mechanism configured to move up the feed tray from a non-supplying position to a supplying position and move down the feed tray from the supplying position to the non-supplying position, the supplying position being a position where the document sheet supported by the feed tray is suppliable into the conveying path by the supplying roller, the non-supplying position being a position where the document sheet supported by the feed tray is not suppliable into the conveying path by the supplying roller, a conveying roller configured to convey the document sheet, which is supplied into the conveying path by the supplying roller, along the conveying path, a driving source configured to generate a driving force, a clutch transmission mechanism configured to transmit the driving force to the supplying roller and the conveying roller such that conveying speed of the conveying roller is faster than conveying speed of the supplying roller when the driving source is driven, and configured to cause a non-supplying period in which the driving force from the driving source is not transmitted to the supplying roller temporarily, a document sensor configured to detect presence and absence of the document sheet supported by the tray, a conveying path sensor configured to detect presence and absence of the document sheet in the conveying path, and a controller. In response to a request for starting conveyance of the document sheet, the controller executes a tray moving up process of moving up the tray from the non-supplying position to the supplying position with using the tray lifting mechanism, when the document sheet is detected by the conveying path sensor, an error process of outputting error information without driving the driving source, and when the document sheet is not detected by the conveying path sensor and when the document sheet is detected by the document sensor, a conveying process of starting a document conveying operation by driving the driving source. In response to a request for stopping conveyance of the document sheet during the document conveying operation, the controller executes, a driving stopping process of stopping driving of the driving source, and a tray moving down process of moving down the tray from the supplying position to the non-supplying position with using the tray lifting mechanism. Further, after executing the driving stopping process and the tray moving down process, the controller executes when the conveying path sensor detects the presence of the document sheet, a document discharging process of driving the driving source at least until the conveying path sensor detects the absence of the document sheet without executing the error process.

BRIEF DESCRIPTION OF THE ACCOMPANYING DRAWINGS

DETAILED DESCRIPTION OF THE EMBODIMENT

Hereinafter, an embodiment according to the present disclosures will be described in detail with reference to the accompanying drawings.

Mechanical Configuration of Image Scanning Device

Figure 1A:
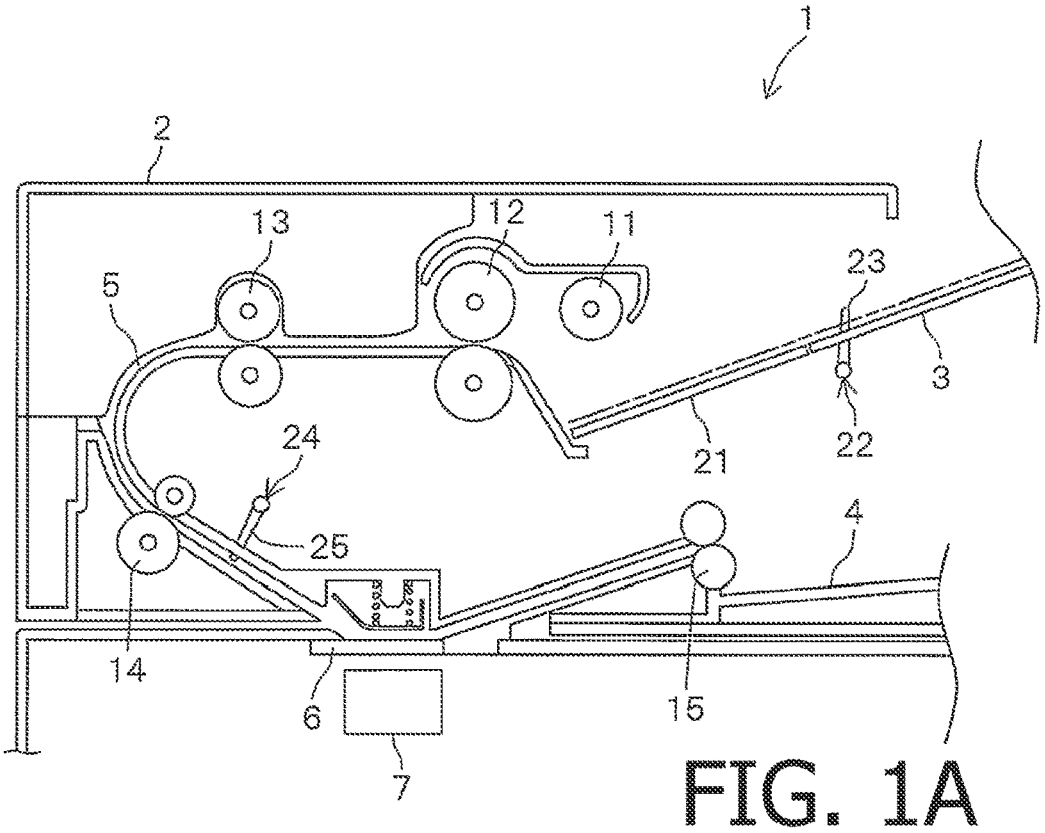
FIG. 1A is a cross-sectional side view of an image scanning device including a document feeder according to aspects of the present disclosures and indicates a state where a movable plate is in a lowermost position.
Figure 1B:
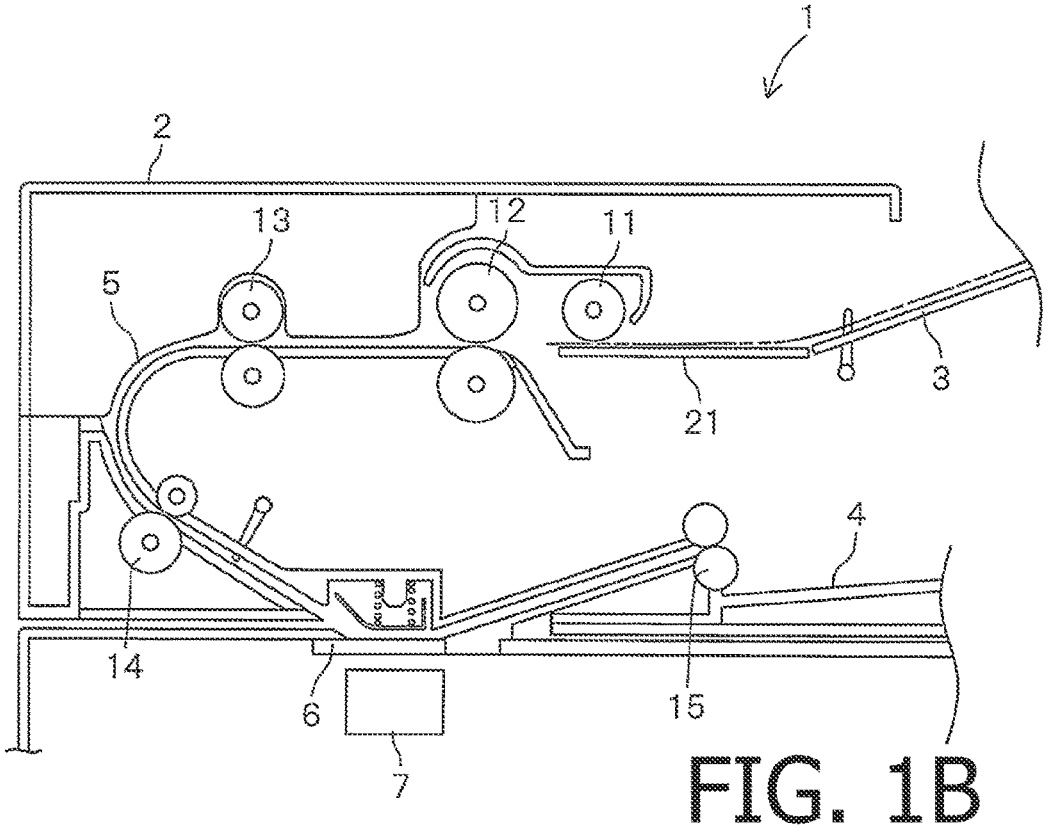
FIG. 1B is a cross-sectional side view of the image scanning device including the document feeder and indicates a state where the movable plate is in a supplying position.

An image scanning device (an example of a document feeder) shown in FIG. 1A and FIG. 1B is a device configured to scan a document sheet using an auto document feeder (ADF).

The image scanning device 1 includes a housing 2. To the housing 2, a feed tray 3 (an example of a tray) and a discharge tray 4 are provided. The feed tray 3 and the discharge tray 4 are arranged so as to at least partially overlap each other when viewed along a vertical direction, with a clearance therebetween. A part of each of the feed tray 3 and the discharge tray 4 is arranged inside the housing 2, and the remaining part of each of the feed tray 3 and the discharge tray 4 is exposed outside from the housing 2. Each of the feed tray 3 and the discharge tray 4 is configured to support a plurality of stacked document sheets.

In the housing 2, a conveying path 5 is formed. One end of the conveying path 5 is opened toward the feed tray 3. The conveying path 5 is extended toward an opposite to the feed tray 3, curved downstream, and extended toward the discharge tray 4. The other end of the conveying path 5 is opened toward the discharge tray 4. The conveying path 5 passes over a contact glass 6 on a discharge tray 4 side with respect to the curved portion. Under the contact glass 6, a scanning device 7 is arranged. The scanning device 7 accommodates a light source and an image sensor. For example, the image sensor has a linear image sensor in which multiple light receiving elements are arranged along a main scanning direction.

In the housing 2, a pickup roller 11 (an example of a feed roller), a separating roller 12 (an example of a feed roller), a first conveying roller 13 (an example of a conveying roller), a second conveying roller 14 (an example of a conveying roller) and a discharging roller 15 (an example of a conveying roller) are arranged in this order, from the feed tray 3 along the conveying path 5.

The pickup roller 11 is arranged at a position where it contacts an upper surface of the document sheet stacked on the feed tray 3 and configured to rotate about a rotation shaft of the separating roller 12. When the pickup roller rotates, an uppermost document sheet, which the pickup roller 11 contacts, is fed into the conveying path 5. The document sheet fed into the conveying path 5 is conveyed by receiving conveying forces which are transmitted from the separating roller 12, the first conveying roller 13, the second conveying roller 14 and the discharging roller 15 in this order, and discharged on the discharge tray 4. When the document sheet passes above the contact glass 6, an image on a surface, which contacts the contact glass 6, of the document is scanned by the scanning device 7. That is, light emitted from the light source of the scanning device 7 illuminates a scanning target surface, which contacts the contact glass 6, of the document sheet and the light reflected by the scanning target surface is received by the image sensor of the scanning device 7, thereby a single line of the image on the scanning target surface being scanned. The image sensor outputs an analog image signal for the scanned single line. Scanning of the image on the scanning target surface is achieved by conveying the document sheet and sequentially scanning the image on the scanning target surface line-by-line from an upstream end to a downstream end in a sub scanning direction, which is a conveying direction.

The feed tray 3 includes a movable plate 21 (an example of a tray) at an end part on a conveying path 5 side. The movable plate 5 is configured to swing, about a shaft extending in the main scanning direction, between a lowermost position extending in the same plane as the feed tray 3 (i.e., a position indicated in FIG. 1A) and a supplying position where the document sheets (specifically, a topmost one of the document sheets) stacked on the feed tray contact the pickup roller 11 from below (i.e., a position indicated in FIG. 1B). When the movable plate 21 is in the lowermost position, the document sheets stacked on the feed tray 3 do not contact the pickup roller 11, and the document sheets cannot be supplied into the conveying path 5.

Further, a document sensor 22 provided to the feed tray 3. The document sensor 22 includes an actuator 23 configured to displace by contacting the document sheets stacked on the feed tray 3, and a sensor (not shown) configured to detect displacement of the actuator 23. When the document sheets are not stacked on the feed tray 3, the actuator 23 is positioned at a non-detection position, and the document sensor 22 outputs an OFF signal. When the document sheets are stacked on the feed tray 3, the actuator 23 is displaced from the non-detection position to a detection position and the document sensor 23 outputs an ON signal.

A conveying path sensor 24 is arranged at a position on a downstream side, in the conveying direction, with respect to the second conveying roller 14 and on an upstream side, in the conveying direction, with respect to the contact glass 6. The conveying path sensor 24 includes an actuator 25 configured to be displaced as the document sheet conveyed in the conveying path 5 contacts, and a sensor (not shown) configured to detect displacement of the actuator 25. When the document sheet does not contact the actuator 25, the actuator 25 is positioned at a non-detection position, at which the conveying path sensor 24 outputs an OFF signal. When the document sheet contacts the actuator 25, the actuator 25 is displaced from the non-detection position to a detection position, at which the conveying path sensor 24 outputs an ON signal.

The document sensor 22 and the conveying path sensor 24 may be configured to detect the presence and absence of the document sheet at a detecting position and may be a reflection type optical sensor, a transmission type optical sensor, a mechanical sensor or an ultrasonic sensor.

Conveying Driving Mechanism

Figure 2:
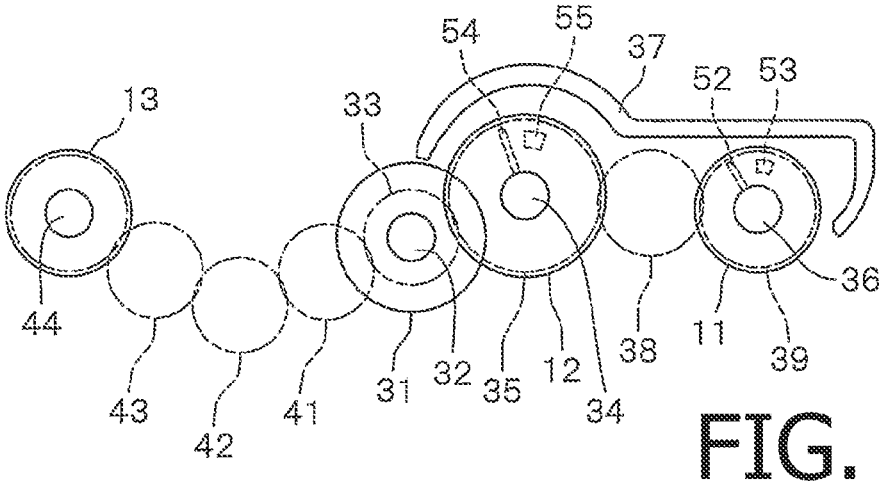
FIG. 2 shows a schematic configuration of a conveying driving mechanism.

As shown in FIG. 2, the image scanning device 1 includes a conveying motor 31 (an example of a driving source) as a driving source of the pickup roller 11, the separating roller 12, the first conveying roller 13, the second conveying roller 14 and the discharging roller 15.

The pickup roller 11 is relatively-rotatably supported by a shaft 36, and the separating roller 12 is relatively-rotatably supported by the shaft 34. A motor gear 33 is supported by a shaft 32 of the conveying motor 31 so as not to rotate relative thereto. A separating roller gear 35 is supported by the shaft 34 so as not to rotate relative thereto. The motor gear 33 is engaged with the separating roller gear 35. The shaft 34 of the separating roller 12 and the shaft 36 of the pickup roller 11 are rotatably supported by a holder 37. By the holder 37, an intermediate gear 38 is rotatably supported. A pickup roller gear 39 is supported by the shaft 36 so as not to rotate relative thereto. The intermediate gear 38 is engaged with both the separating roller 35 and the pickup roller gear 39.

Further, the motor gear 33 is connected to a first conveying roller gear 44 through a transmission gear mechanism, which includes transmission gears 41, 42 and 43. The first conveying roller gear 44 is supported by a shaft 44 of the first conveying roller 13 so as not to rotate relative thereto. The motor gear 33 may be directly engaged with the first conveying roller 44 without the transmission gears 41, 42 and 43. Further, in order to transmit a driving force, the motor gear 33 is engaged with a second conveying roller gear (not shown), which is supported by a shaft of the second conveying roller 14 so as not to rotate relative thereto, and with a discharging roller gear (not shown), which is supported by a shaft of the discharging roller 15 so as not to rotate relative thereto.

The image scanning device 1 is provided with a clutch transmission mechanism configured to cause a non-supplying period in which transmission of the driving force from the conveying motor 31 to the pickup roller 11 and the separating roller 12 is temporarily stopped. Specifically, a driven engaging part 53 is projected from a side surface of the pickup roller 11. Further, a driving engaging part 52 is formed on the shaft 36 of the pickup roller 11 at the same position as the driven engaging part 53 in an axis direction. The driving engaging part 55 has a cylindrical shape protruding from a circumference surface of the shaft 36 in a radial direction. A driven engaging part 55 is projected from a side surface of the separating roller 12. Further, a driving engaging part 54 is formed on the shaft 34 of the separating roller 12 at the same position, in the axis direction, as the driven engaging part 55. The driving engaging part 54 has a cylindrical shape extending from a circumference surface of the shaft 34 in a radial direction.

When the conveying motor 31 is driven, the motor gear 33 rotates, and a driving force is transmitted from the motor gear 33 to the separating gear 35 and the separating roller gear 35 rotates. Therefore, the driving engaging part 54 approaches the driven engaging part 55. Further, the driving force is transmitted from the separating roller gear 35 to the pickup roller gear 39 via the intermediate gear 38, and the pickup roller gear 39 rotates in a forward direction. By the rotation of the pickup roller gear 39, the driving engaging part 52 approaches the driven engaging part 53.

The driving engaging part 52 is configured to engage with the driven engaging part 53 by contact before the driving engaging part 54 engages with the driven engaging part 55, and when the driving engaging part 52 pushes the driven engaging part 53, the pickup roller 11 starts to rotate. As the pickup roller 11 starts to rotate, conveyance of one of the document sheets is started by a conveying force received from the pickup roller 11.

Since the driving engaging part 54 does not engage with the driven engaging part 55, the separating roller 12 does not rotate but stays unrotated. When the driving engaging part 54 engages with the driven engaging part 55 by contact, the driving engaging part 54 pushes the driven engaging part 55, thereby the separating roller 12 starting to rotate. As the separating roller 12 rotates, the document sheet receives a conveying force from the separating roller 12, thereby the document sheet being conveyed by the conveying force.

The driving force of the conveying motor 31 is transmitted from the motor gear 33 to the first conveying roller gear 44 and rotates the first conveying roller 13. Similarly, the second conveying roller 12 and the discharging roller 15 are rotated by the driving force of the conveying motor 31. The document sheet conveyed by the separating roller 12 receives a conveying force from the first conveying roller 13 when arriving at the first conveying roller 13 and is conveyed by the received conveying force.

Due to the design of roller diameters of the separating roller 12 and the first conveying roller 12, and gear ratios between the separating roller gear 35, the pickup roller gear 39 and the first conveying roller gear 44, circumferential speeds (i.e., conveying speeds) of more downstream side ones of the pickup roller 11, the separating roller 12 and the first conveying roller 13 are higher in this order. Therefore, when the document sheet starts to receive the conveying force from the separating roller 12, the document sheet is pulled by the conveying force of the separating roller 12, and the rotation speed of the pickup roller 11 accelerates as being pulled by the document sheet. Further, when the document sheet starts to receive the conveying force from the first conveying roller 13, the document sheet is pulled by the conveying force of the first conveying roller 13, and the rotation speed of the separating roller 12 further accelerates as being pulled by the document sheet. Thus, the driven engaging part 53 separates from the driving engaging part 52 toward a downstream side in a rotation direction, and the driven engaging part 55 separates from the driving engaging part 54 toward a downstream side in a rotation direction. Therefore, each of the pickup roller 11 and the separating roller 12 can idle by approximately one rotation.

Tray Lifting Mechanism

Figure 3A:
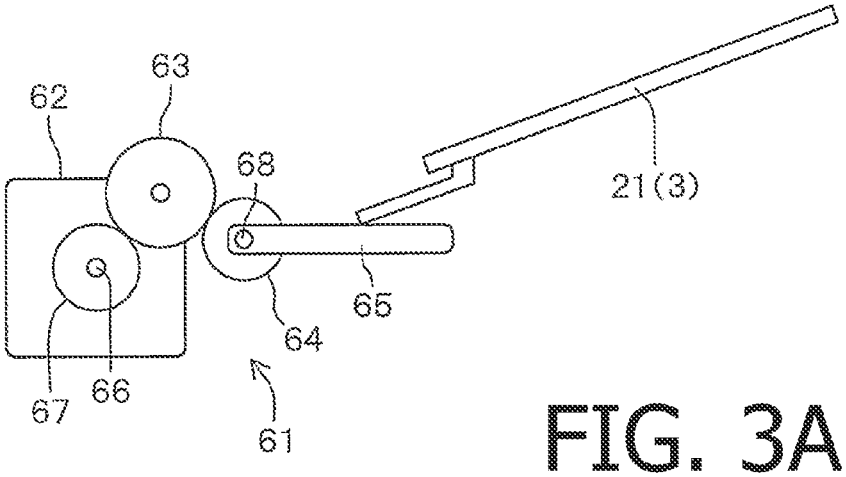
FIG. 3A shows a schematic configuration of a tray lifting mechanism and indicates a state where the movable plate is in the lowermost position.
Figure 3B:
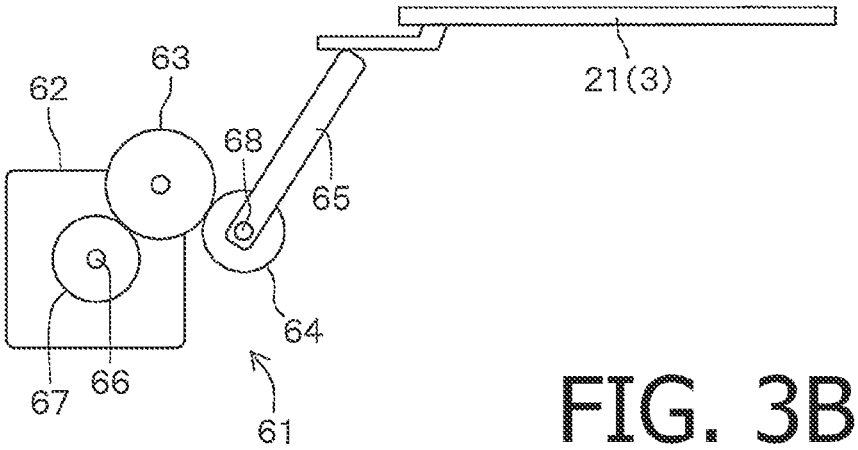
FIG. 3B shows a schematic configuration of the tray lifting mechanism and indicates a state where the movable plate is in the supplying position.

The image scanning device 1 is provided with, as shown in FIGS. 3A and 3B, a tray lifting mechanism 61 configured to move up and down the movable plate 21 of the feed tray 3 between the lowermost position and the supplying position. The tray lifting mechanism 61 includes a swing motor 62, a transmission gear 63, a lift gear 61 and a lift arm 65.

Each of rotation axes of the swing motor 62, the transmission gear 63 and the lift gear 64 extends in the main scanning direction. A motor gear 67 is supported by a shaft 66 of the swing motor 66 so as not to rotate relative thereto. The motor gear 67 is engaged with the transmission gear 63. The transmission gear 63 is engaged with the lift gear 67. The lift gear 64 and the lift arm 65 are supported by shaft 64 so as not to rotate relative to each other. A leading end part of the lift arm 65 (i.e., an opposite end which is opposite to the end part supported by the shaft 64) contacts the movable plate 21 from below.

As shown in FIG. 3A, in response to the motor gear 67 being rotated by a driving force of the swing motor 62 when the movable plate 21 is in the lowermost position, the transmission gear 63 rotates clockwise and the lift gear 64 rotates counterclockwise in FIG. 3A. With the rotation of the lift gear 64, the leading end part of the lift arm 65 is moved up, and the movable plate 21 is pushed up from below by the leading end part of the lift arm 65. Thus, the movable plate 21 is moved up from the lowermost position toward the supplying position.

As shown in FIG. 3B, in response to the motor gear 67 being rotated clockwise by a driving force of the swing motor 62 when the movable plate 21 is in the supplying position, the transmission gear 63 rotates counterclockwise, and the lift gear 64 rotates clockwise. With the rotation of the lift gear 64, the leading end part of the lift arm 65 is moved down, and the movable plate 21 is moved down toward the lowermost position by weights of the movable plate 21 and the document sheets.

Electrical Configuration of Image Scanning Device

Figure 4:
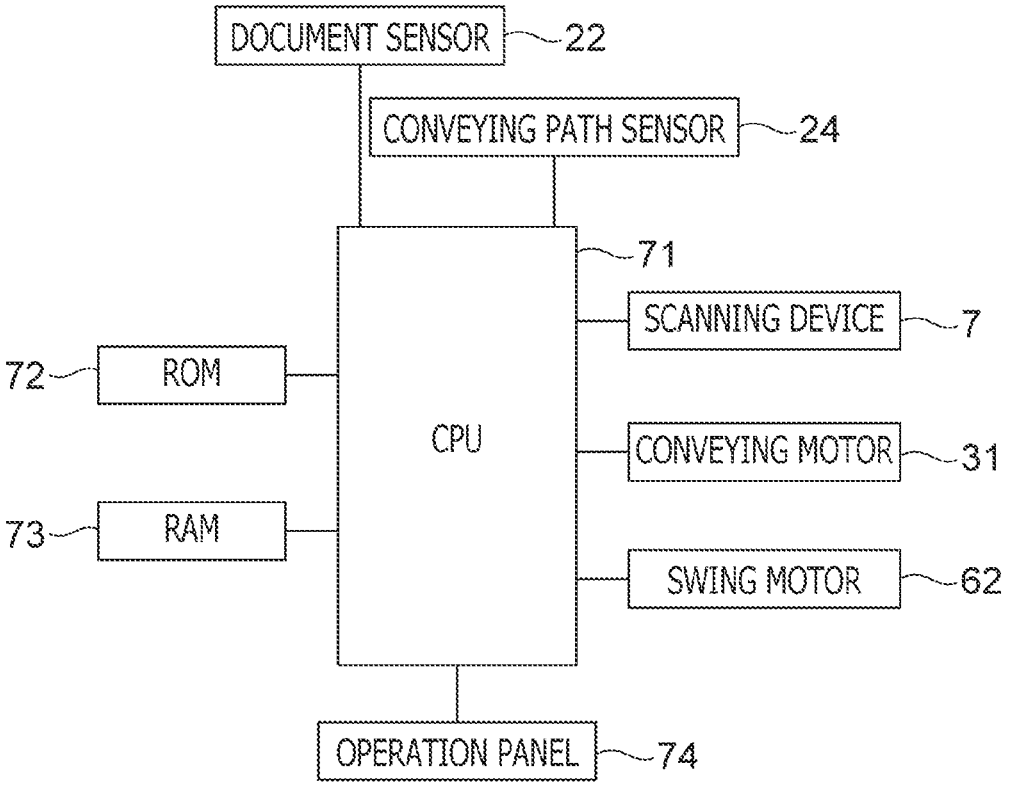
FIG. 4 is a block diagram showing an electrical configuration of the image scanning device.

As shown in FIG. 4, the image scanning device 1 includes a central processing unit (CPU) 71, a ROM (read only memory) 72, and a RAM (random access memory) 73. The ROM 72 stores programs to be executed by the CPU 71 and various types of data. The RAM 73 is a volatile memory such as a dynamic random access memory (DRAM) and uses as a work area when the CPU 71 executes the programs.

The analog signal output from the scanning device 7 is converted to a digital signal, for example, by an analog front end (AFE) and input to the CPU 71 (an example of a controller). A sensor signal output from each of the document sensor 22 and the conveying path sensor 24 is input to the CPU 71.

The CPU 71 configured to control each part of the image scanning device 1 such as the conveying motor 31, the swing motor 62, an operation panel 74, which is a user interface, or the like by executing the programs for various processes based on signals input from the document sensor 22, the conveying sensor 24 and the like. The operation panel 74 is, for example, a touch panel and configured by stacking an operation unit such as a pressure-sensitive or capacitance-type transparent film switch on a display unit such as a liquid crystal display. On the display unit, images such as various types of information, an operation key or the like are displayed. Upon the user touching the operation key displayed on the display unit, the operation unit receives an instruction corresponding to a type of the operation key touched by the user. When the operation unit receives the instruction, a signal (i.e., data) corresponding to the instruction is transmitted from the operation panel 74 to the CPU 71.

It is noted that the display unit and the operation unit may be provided separately, without forming the touch panel.

Conveying Process

Figure 5A:
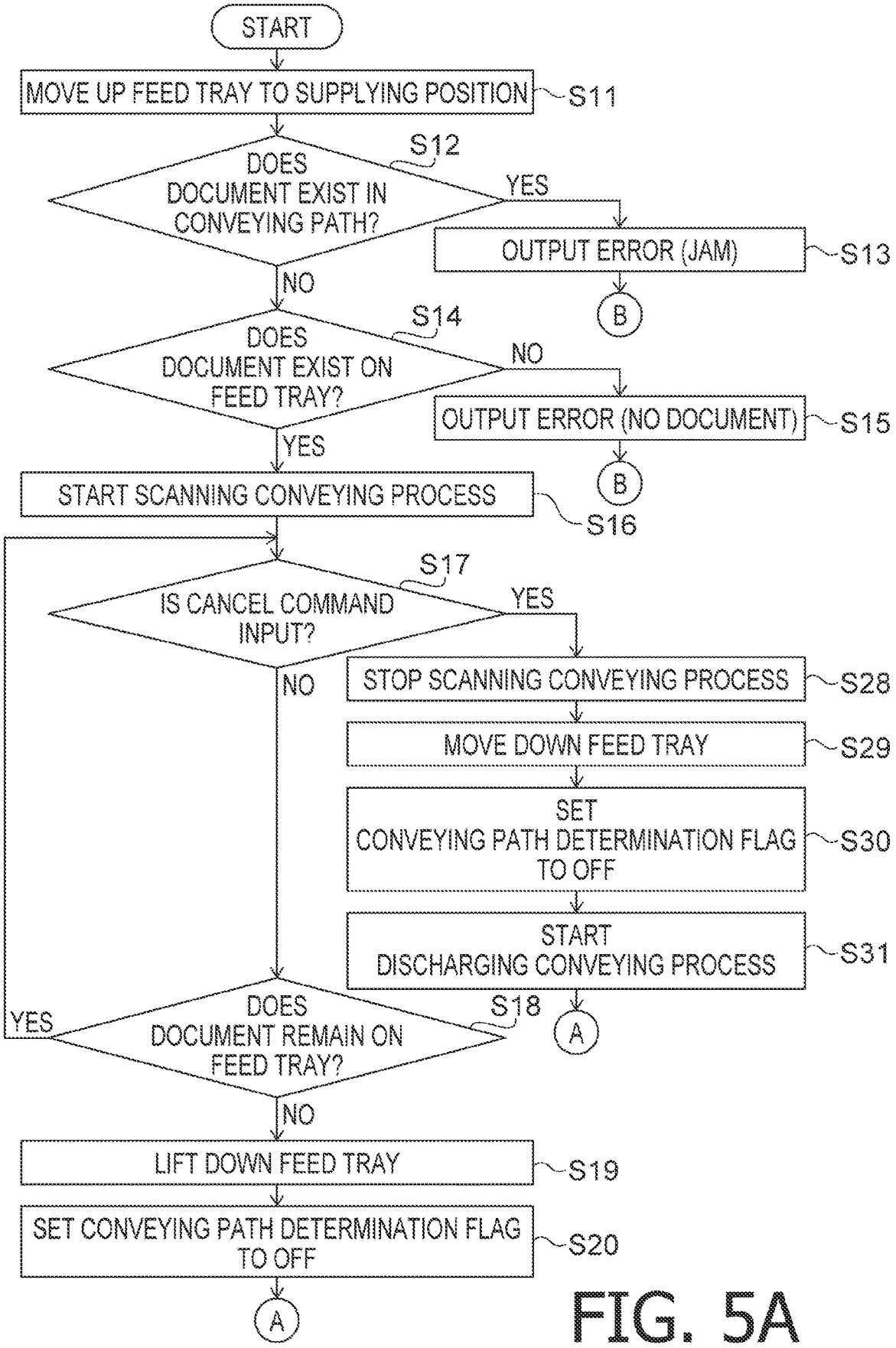
FIGS. 5A, 5B and 5C show a flowchart illustrating a conveying process.
Figure 5B:
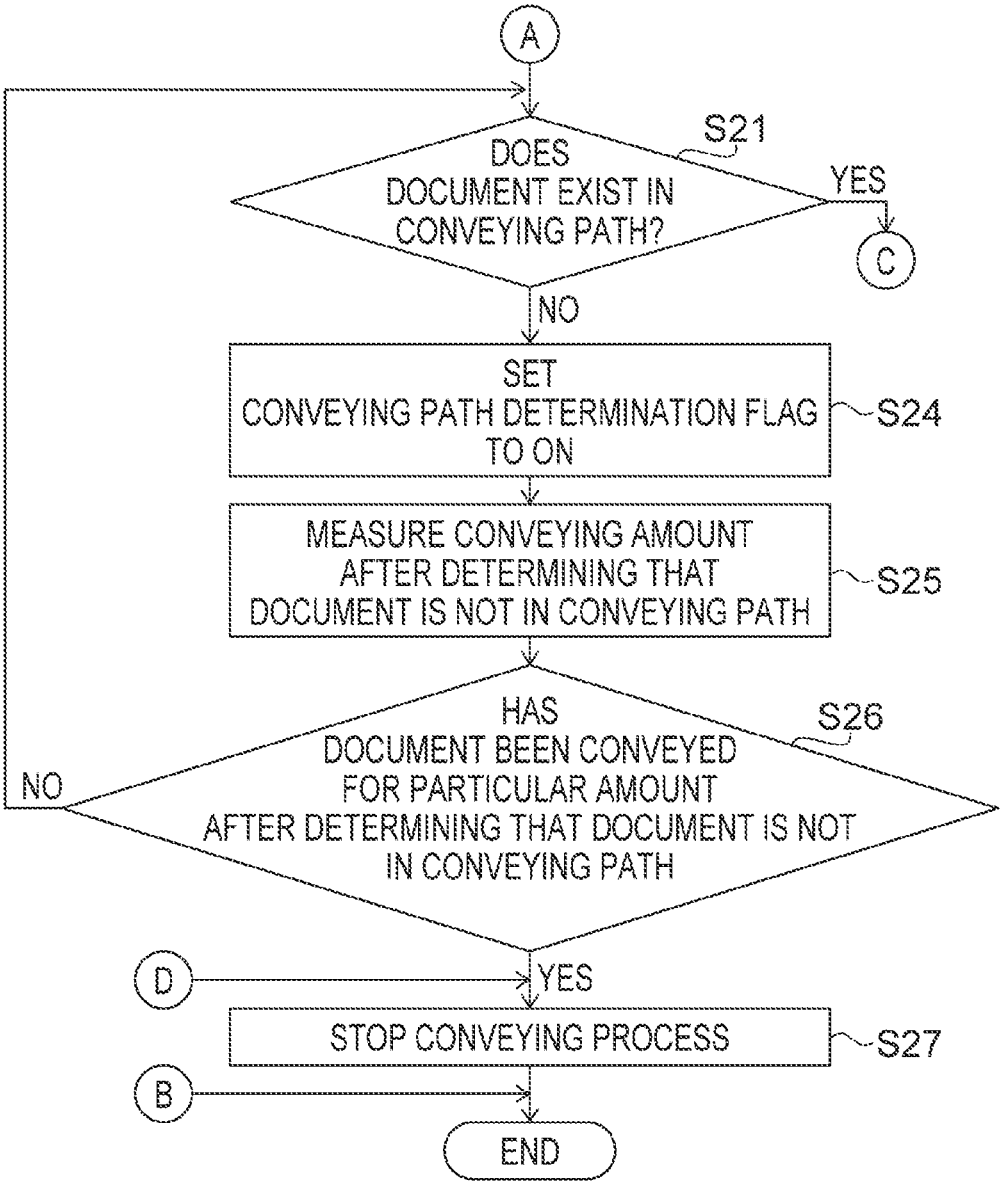
Figure 5C:
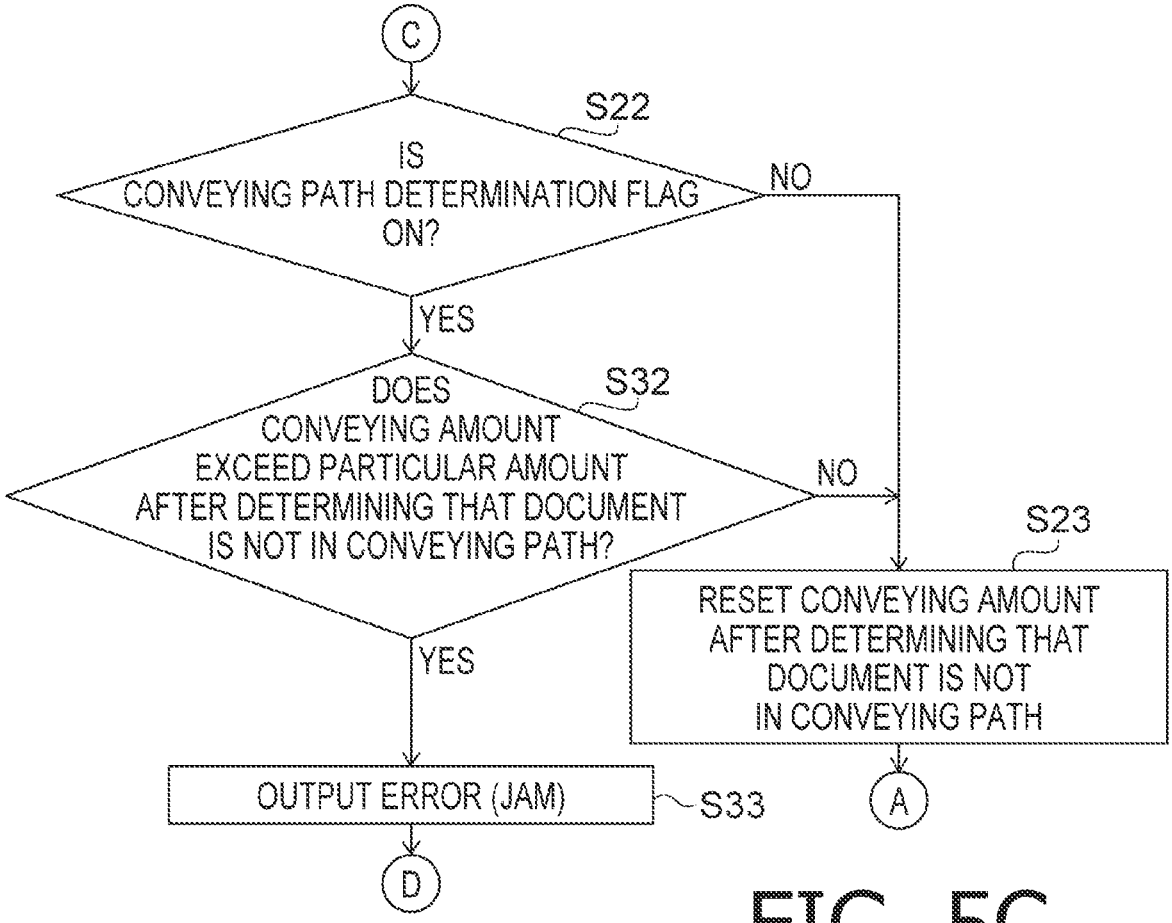

When the document sheet is scanned, the CPU 71 executes a conveying process indicated in FIGS. 5A and 5B.

In the conveying process, firstly, the CPU 71 controls the swing motor 62 to move up the movable plate 21 of the feed tray 3 from the lowermost position to the supplying position (S11).

Next, the CUP 71 determines the presence and absence of the document sheet in the conveying path 5, referring to a detection signal of the conveying path sensor 24 (S12). When the CPU 71 determines that the document sheet exists in the conveying path 5 (S12: YES), the CPU 71 notifies a jam error (S13) and terminates the conveying process. In accordance with the notified jam error, error information indicating that the jam has occurred in the conveying path 5 is displayed on the operation panel 74.

When determining that the document sheet does not exist in the conveying path 5 (S12: NO), the CPU 71 determines whether the document sheet is stacked on the feed tray 3, referring to a detection signal of the document sensor 22 (S14). When determining that the document sheet is not present on the feed tray 3 (S14: NO), the CPU 71 outputs error information indicating that the document sheet is not set in the feed tray 3 (S15) and terminates the conveying process. In accordance with the error information, an error message indicating that the document sheet is not set in the feed tray 3 is displayed on the operation panel 74.

When the document does not exist in the conveying path 5 and the document is stacked on the feed tray 3 (S14: YES), the CPU 71 controls the conveying motor 31 and starts a scanning conveying process of conveying the document to be scanned (S16).

After starting the scanning conveying process, the CPU 71 determines whether a cancel command is input (S17). The cancel command can be input by the user operating the operation panel 74. If the image scanning device 1 is communicably connected to an external device, the cancel command can be input from the external device.

When determining that the cancel command does not exist (S17: NO), the CPU 17 determines whether the document sheets remain on the feed tray 3 (S18). When determining that the document sheets remain on the feed tray 3 (S18: YES), the CPU 71 determines again whether there exist the cancel commands (S17).

When conveyance of the document sheets stacked on the feed tray 3 proceeds, and all the document sheets stacked on the feed tray 3 have been fed (i.e., when no document sheet remains on the feed tray 3) (S18: NO), the CPU 71 controls the swing motor 62 to move down the movable plate 21 of the feed tray 3 from the supplying position to the lowermost position (S19). Further, the CPU 71 sets a conveying path determination flag stored in the RAM 73 to "OFF" (S20).

Thereafter, the CPU 71 determines whether the document sheet exists in the conveying path 5, referring to the detection signal of the conveying path sensor 24 (S21). After all the document sheets have been fed from the feed tray 3 and while the last document sheet to be conveyed remains in the conveying path 5, the CPU 71 determines that the document sheet exists in the conveying path 5 based on the detection signal of the conveying path sensor 24 (S21: YES) and checks the conveying path determination flag (S22). At this time, since the conveying path determination flag is set to "OFF," the CPU 71 determines that the conveying path determination flag is not "ON" (S22: NO), resets a conveying amount after determining that the document sheet does not exist in the conveying path 5 (described later) to zero (S23) and determines whether the document sheet exists in the conveying path 5 again (S21).

When the CPU 71 determines that the document sheet does not exist in the conveying path 5 (S21: NO), the CPU 71 sets the conveying path determination flag to "ON" (S24). Further, the CPU 71 measures the conveying amount after determining that the document sheet does not exist in the conveying path 5 (S25). Since a conveying speed is known, the conveying amount after determining that the document sheet does not exist in the conveying path 5 can be calculated based on an elapsed time from when it is determined that the document sheet does not exist in the conveying path 5. Further, the elapsed time from when it is determined that the document sheet does not exist in the conveying path 5 may be considered as the conveying amount after determining that the document sheet does not exist in the conveying path 5.

The CPU 71 determines whether a particular amount of the document sheet has been conveyed after determining that the document sheet does not exist in the conveying path 5, that is, whether the conveying amount of the document sheet after determining that the document sheet does not exist in the conveying path 5 reaches the particular amount (S26). The particular amount is set to a value obtained by adding a particular margin amount to a conveying distance or a time period from when the document sheet does not exist on the feed tray 3 until when a rear end of the last document sheet to be conveyed has passed through the discharging roller 15.

When the CPU 71 determines that the particular amount of the document sheet has been conveyed after determining that the document sheet does not exist in the conveying path 5 (S26: YES), the CPU 71 stops the conveying process by stopping the conveying motor 31 (S27) and terminates the conveying process.

Further, when a cancel instruction is input during conveying the document sheet (S17: YES), the CPU 71 temporarily stops driving the conveying motor 31 and stops the scanning conveying process (S28). Further, the CPU 71 controls the swing motor 62 to move down the movable plate 21 of the feed tray 3 from the supplying position to the lowermost position (S29). At the time, the movable plate 21 of the feed tray 3 may be moved down from the supplying position to a non-supplying position before the lowermost position, that is, to a position where the document sheet remained on the feed tray 3 separates from the pickup roller 11 and where the document sheet is not fed from the feed tray 3 even when the pickup roller 11 rotates. However, by moving down the movable plate 21 to the lowermost position, it becomes easier to take out the document sheet remained on the feed tray 3. It is noted that the lowermost position is also the non-supplying position.

Then, before starting a discharging process of discharging the document sheet, the CPU 71 sets the conveying path determination flag to "OFF" so as not to detect the document sheet remained in the conveying path 5 as a jammed document sheet (S30). Thereafter, the CPU 71 starts the discharging conveying process of discharging the document sheet from the conveying path 5 (S31).

Then, the CPU 71 determines whether the document sheet exists in the conveying path 5, referring to the detection signal of the conveying path sensor 24 (S21). When determining that the document sheet exists in the conveying path 5 based on the detection signal of the conveying path sensor 24 (S21: YES), the CPU 71 checks a state of the conveying path determination flag (S22). When the conveying path flag is set to "OFF" (S22: NO), the CPU 71 determines that the discharging conveying process is in execution, resets the conveying amount of the document sheet after determining that the document sheet is absent in the conveying path 5 to zero (S23), continues to the discharging conveying process, and determines again whether the document sheet exists in the conveying path 5 (S21).

When determining that the document sheet is absent in the conveying path 5 (S21: NO), the CPU 71 sets the conveying path determination flag to "ON" (S24). It is because a document sheet, which is temporarily detected to be absent in the conveying path 5, may be re-detected by the conveying path sensor 24, and such detection can be effected as a jam detection.

For example, when the movable plate 21 of the feed tray 3 is moved down while the feed tray 3 is full of document sheets, a topmost one of the document sheets remained on the feed tray 3 may be pulled by the separating roller 12 and conveyed in the conveying path 5. When such a situation occurs, it is highly possible that the document is not being conveyed in a correct orientation, and a jam could occur if the document sheet is kept conveyed.

Therefore, according to the present embodiment, after the document sheet is temporarily absent in the conveying path 5, the conveying path determination flag is set to "ON" so that a jam can be detected.

Further, the CPU 71 measures the conveying amount of the document sheets after determining that the document sheet is absent in the conveying path 5 (S25). Then, the CPU 71 determines whether the document sheet is conveyed by a particular amount after determining that the document sheet is not in the conveying path 5 (S26). When determining that the document sheet is not conveyed by the particular amount (S26: NO), the CPU 71 determines again whether the document sheet exists in the conveying path 5 (S21).

When the document sheet is detected by the conveying path sensor 24 after the document was temporarily absent in the conveying path 5, since the conveying path flag is set to "ON," the CPU 71 determines that the conveying path flag is "ON" (S22: YES) after determining that the document sheet is present in the conveying path 5 (S21: YES). Then, the CPU 11 determines whether the conveying amount of the document sheets, which is measured after determining that the document sheet is not in the conveying path 5, exceeds (i.e., is higher than) the particular amount (S32).

When determining that the conveying amount of the document sheets, which is measured after determining that the document sheet is absent in the conveying path 5, is higher than the particular amount (S32: YES), the CPU 71 outputs error information indicating the occurrence of the sheet jam (S33), stops the conveying operation and terminates the conveying process. In accordance with the error information, an error message, which indicates that the sheet jam is occurring in the conveying path 5, is displayed on the operation panel 74. On the other hand, when determining that the conveying amount of the document sheets, which is measured after determining that the document sheet is absent in the conveying path 5, is not higher than the particular amount (S32: NO), the CPU 71 resets the conveying amount after determining that the document sheet is absent in the conveying path 5 to zero (S23) and determines again whether the document is in the conveying path 5 (S21).

The particular amount may be a value equal to distance (i.e., interval) between the document sheets when the document sheets, each of which has a maximum length readable by the image scanning device 1, are sequentially conveyed in the conveying path 5. In that case, it is possible to accurately detect the occurrence of the sheet jam in the conveying path 5. Further, the particular amount may be a value equal to a length of the document sheet discharged from the conveying path 5 right before determining the conveying amount. In that case, it is possible to shorten a time period necessary for the conveying operation in a state where the document sheet is not in the conveying path 5 in comparison where the particular amount is equal to the maximum length.

Effects

As described above, when the cancel command is input during execution of the document conveying process, the conveying motor 31 is temporarily stopped. Then, after the movable plate 21 of the feed tray 3 is moved down from the supplying position to the lowermost position (an example of the non-supplying position), the drive of the conveying motor 31 is restarted. The conveying motor 31 is driven at least until the document sheet is discharged from the conveying path 5. Thus, it is possible to prevent the document sheets stacked on the feed tray 3 from being sequentially fed into the conveying path 5, and discharge the document sheet in the conveying path 5 when the document sheet exists in the conveying path 5.

With this configuration, when the conveyance of the document sheet is stopped, it is possible to prevent the document sheets from being conveyed unnecessarily and stop the conveying process at an early stage.

Further, according to the aspects of the present disclosures, the driving of the conveying motor 31 is continued until a particular time period necessary for conveying the document sheet by the particular amount has passed since the document sheet is no longer detected by the conveying path sensor 24 and the CPU 71 determines that the document sheet is absent in the conveying path 5. Therefore, even if the rear end of a preceding document sheet is stopped, by coincidence, just before passing the position of the conveying path sensor 24, and immediately thereafter, a subsequent document sheet is about to reach the position of the conveying path sensor 24, it is ensured that the subsequent document sheet can be discharged from the conveying path 5.

Modifications

Although one embodiment according to the present disclosures is described above, the present disclosures can be implemented in other forms, and various design modifications can be applied to the above embodiment within a scope of the claims.

In the above embodiment, after the feed tray is moved up to the supplying position, it is determined whether the document sheet is in the conveying path or the feed tray. Alternatively, after determining whether the document sheet is in the conveying path or the feed tray, the feed tray may be moved up only when a particular condition is satisfied. Thus, it is possible to prevent the feed tray from being unnecessarily moved.

What is claimed is:

1. A document feeder comprising:

a feed tray configured to support a document sheet;

a supplying roller configured to supply the document sheet supported by the feed tray into a conveying path;

a tray lifting mechanism configured to move up the feed tray from a non-supplying position to a supplying position and move down the feed tray from the supplying position to the non-supplying position, the supplying position being a position where the document sheet supported by the feed tray is suppliable into the conveying path by the supplying roller, the non-supplying position being a position where the document sheet supported by the feed tray is not suppliable into the conveying path by the supplying roller;

a conveying roller configured to convey the document sheet, which is supplied into the conveying path by the supplying roller, along the conveying path;

a driving source configured to generate a driving force;

a clutch transmission mechanism configured to transmit the driving force to the supplying roller and the conveying roller such that conveying speed of the conveying roller is faster than conveying speed of the supplying roller when the driving source is driven, and configured to cause a non-supplying period in which the driving force from the driving source is not transmitted to the supplying roller temporarily;

a document sensor configured to detect presence and absence of the document sheet supported by the tray;

a conveying path sensor configured to detect presence and absence of the document sheet in the conveying path; and a controller, wherein, in response to a request for starting conveyance of the document sheet, the controller executes:

a tray moving up process of moving up the tray from the non-supplying position to the supplying position with using the tray lifting mechanism;

when the document sheet is detected by the conveying path sensor, an error process of outputting error information without driving the driving source; and when the document sheet is not detected by the conveying path sensor and when the document sheet is detected by the document sensor, a conveying process of starting a document conveying operation by driving the driving source, and wherein, in response to a request for stopping conveyance of the document sheet during the document conveying operation, the controller executes:

a driving stopping process of stopping driving of the driving source;

a tray moving down process of moving down the tray from the supplying position to the non-supplying position with using the tray lifting mechanism after executing the driving stopping process and the tray moving down process, when the conveying path sensor detects the presence of the document sheet, a document discharging process of driving the driving source at least until the conveying path sensor detects the absence of the document sheet without executing the error process.

2. The document feeder according to claim 1, wherein, in the document discharging process, the controller continues to drive the driving source until a particular period has passed from when the conveying path sensor detects absence of the document sheet.

3. The document feeder according to claim 1, wherein the controller continues to drive the driving source for a particular period in the document discharging process even when the conveying path sensor detects absence of the document sheet after executing the tray moving down process.

4. The document feeder according to claim 1, wherein the controller executes the document discharging process after executing the tray moving down process.

5. The document feeder according to claim 1, wherein the non-supplying position is within a range including a lowermost position, the lowermost position being a position of the tray when the tray is moved down most by the tray lifting mechanism, and wherein the controller moves down the tray to the lowermost position in the tray moving down process.

6. The document feeder according to claim 1, wherein the controller measures a conveying amount in the document discharging process after an indication of a determining result of the conveying path sensor is changed from the presence to the absence, and wherein, when the conveying path sensor detects the presence of the document sheet after the measured conveying amount exceeds a non-supplying period conveying amount, which is a conveying amount of the document sheet in the non-supplying period, the controller stops the driving the driving source and outputs the error information.

7. The document feeder according to claim 6, wherein the non-supplying period conveying amount is equal to a conveying amount of the document sheet having a maximum length conveyable by the document feeder in the non-supplying period.

8. The document feeder according to claim 6, wherein the non-supplying period conveying amount is determined based on the length of the document which is discharged lastly in the document discharging process.

* * * * *